US007410743B2

(12) United States Patent
Chambers et al.

(10) Patent No.: US 7,410,743 B2
(45) Date of Patent: Aug. 12, 2008

(54) IMAGING SYSTEMS AND METHOD THAT FORM A LAYER ON AN IMAGING MEMBER

(75) Inventors: John Chambers, Rochester, NY (US); Francisco Lopez, Rochester, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 352 days.

(21) Appl. No.: 11/138,347

(22) Filed: May 27, 2005

(65) Prior Publication Data

US 2006/0269662 A1 Nov. 30, 2006

(51) Int. Cl.
*G03G 5/06* (2006.01)

(52) U.S. Cl. ..... 430/133; 430/135

(58) Field of Classification Search ..... 430/133, 430/135

See application file for complete search history.

(56) References Cited

U.S. PATENT DOCUMENTS

| | | | | |
|---|---|---|---|---|
| 3,624,796 | A * | 11/1971 | Brociner | 241/23 |
| 4,852,811 | A * | 8/1989 | Adams et al. | 241/1 |
| 2006/0127781 | A1 * | 6/2006 | Zhang et al. | 430/59.4 |

* cited by examiner

*Primary Examiner*—John L Goodrow
(74) *Attorney, Agent, or Firm*—Oliff & Berridge, PLC

(57) ABSTRACT

A method includes pre-milling a pigment by dry ball milling the pigment with crushed $CO_2$ (s), reducing the size of particles of the pigment by milling the pigment with glass beads, measuring a size of the particles of the pigment, determining whether that size of the particles is acceptable and coating the imaging member with the pigment if it is determined that the size of the particles is acceptable. A system includes a mill, a measuring device, a coating device and a controller that controls the mill to dry ball mill a pigment with crushed $CO_2$, and then controls the mill to reduce the size of the pigment by milling the pigment with glass beads. The controller controls the measuring device to measure a size of the particles of the pigment to determine whether the size of the particles is acceptable. The imaging member is then coated with the solution.

12 Claims, 4 Drawing Sheets

IMAGING SYSTEMS AND METHOD THAT FORM A LAYER ON AN IMAGING MEMBER

BACKGROUND

Imaging systems may include an imaging member such as a photoreceptor. In many instance, the imaging member is formed using a coating material that includes a pigment for a charge-generating layer or photoconductive layer. For example, hydroxygallium phthalocyanine is a pigment with high sensitivity. However, using the pigment hydroxygallium phthalocyanine with current methods that form the charge-generating layer can cause a high dark decay and induce charge deficient spots.

There have been efforts to improve the performance of hydroxygallium phthalocyanine in cyclic stability, print quality, and coating quality by reducing the raw pigment and subsequent dispersion particle size of conventional pigments. For example, a useful polymorph Type V (hydroxygallium phthalocyanine (V)) has been converted from crude hydroxygallium phthalocyanine (hydroxygallium phthalocyanine (I)) by using a process of ball milling in the pigment using a solvent. Moreover, different hydroxygallium phthalocyanine (V) synthesis and grinding routes have been used to reduce particle size. Current pigments used in coating materials that form photoreceptors are highly sensitive and composed of various particle sizes.

SUMMARY

Conventional systems and methods do not efficiently form the pigment material. The milling time required to reduce the particle size of the pigment to an acceptable size is too long, resulting in increased manufacturing time and costs.

Moreover, the conventional systems and methods do not allow a uniform distribution of the pigment on a photoreceptor. For example, the pigments are not dispersed satisfactorily within the charge-generating layer because of inconsistent particle sizes. Thus, the print quality of the image is significantly degraded.

Because of the problems associated with the conventional coating material that includes the pigment, there is a need for a coating material including a pigment that improves print quality and overall pigment performance by better dispersing the pigment particles in the charge-generating layer. The coating material with the pigment also needs to be formed using a shorter milling time.

A pigment material for an imaging member may include a pigment that is dry ball milled prior to the conversion to hydroxygallium phthalocyanine (V) from crude hydroxygallium phthalocyanine (I). The dry ball milling step prior to the conversion significantly reduces or eliminates any unacceptable (e.g., oversized) particles within the coating material. The result is that the pigment material is better dispersed over the charge-generating layer of the imaging member. Moreover, there is a reduction in the milling time, and the print quality is greatly improved.

A method of forming a layer on an imaging member includes pre-milling a pigment material by dry ball milling the pigment material with crushed $CO_2$ (s), reducing the size of particles of the pigment material by milling the pre-milled pigment material with glass beads, measuring a size of the particles of the milled pigment material, determining whether that size of the particles is acceptable and coating the imaging member with the milled pigment material if it is determined that the measured size of the particles is acceptable.

An layer forming system that forms a layer on an imaging member includes a mill, a measuring device, a coating device and a controller that controls the mill to dry ball mill a pigment material with crushed $CO_2$ (s), and controls the mill to reduce the size of the particles of the dry ball milled pigment by milling the pigment material with glass beads. The controller then controls the coating device to coat the imaging member with the pigment material when it is determined that the size of the particles is acceptable.

The $CO_2$ (s) may be used during the dry ball milling step to further reduce the occurrence of large pigments and improve pigment dispersability. The improved pigment material may be formed without drastically altering production equipments in order to save capital investment and reduce space constraints.

BRIEF DESCRIPTION OF THE DRAWINGS

Various exemplary embodiments of the systems and methods according to the invention will be described in detail, with reference to the following figure, wherein.

DETAILED DESCRIPTION OF EMBODIMENTS

Figure 1:
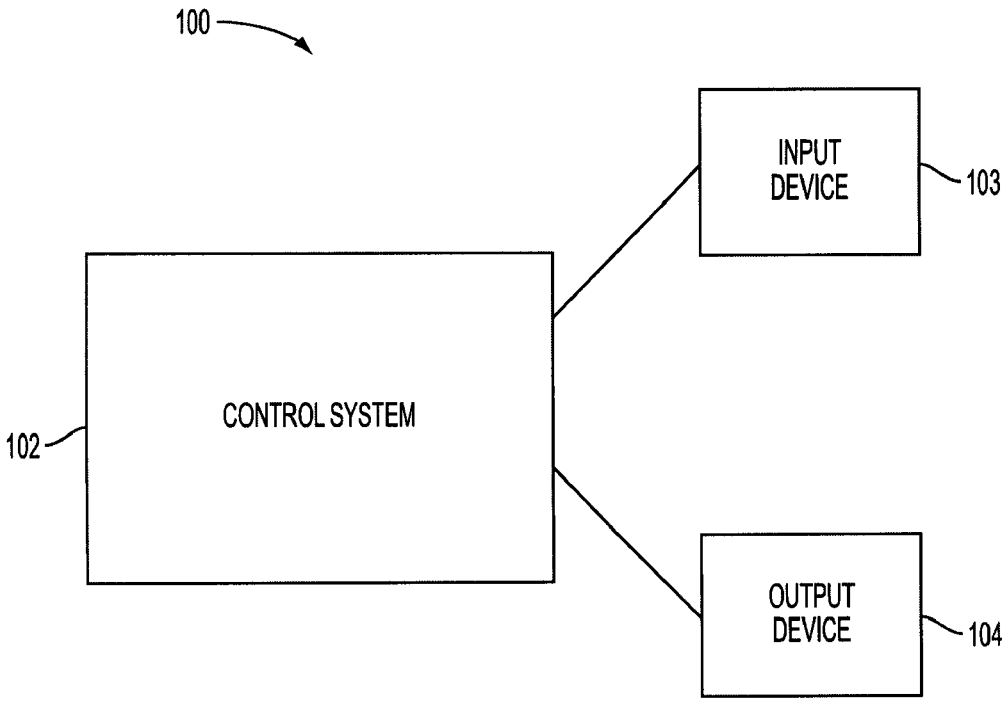
FIG. 1 is an exemplary diagram of an imaging member forming system.

FIG. 1 is an exemplary diagram of an imaging member forming system 100 that may be used to form a layer on an imaging member. The imaging member forming system 100 may be used, for example, to form a photoreceptor for a printing system. However, it should be appreciated that the imaging member forming system 100 may be used to form a layer on any known member that retains or forms an image without departing from the spirit and scope of the disclosure.

As shown in FIG. 1, the imaging member forming system 100 may include a control system 102 connected to an input device 103 and an output device 104. The input device 103 may be any device that allows the transmission and/or reception of control signals between the input device 103 and the control system 102. For example, the input device 103 may be a personal computer, work station, personal digital assistant (PDA) or a mobile telephone, and any peripheral device associated with these input devices. The output device 104 may be, for example, an apparatus that forms various layers on an imaging member.

Figure 2:
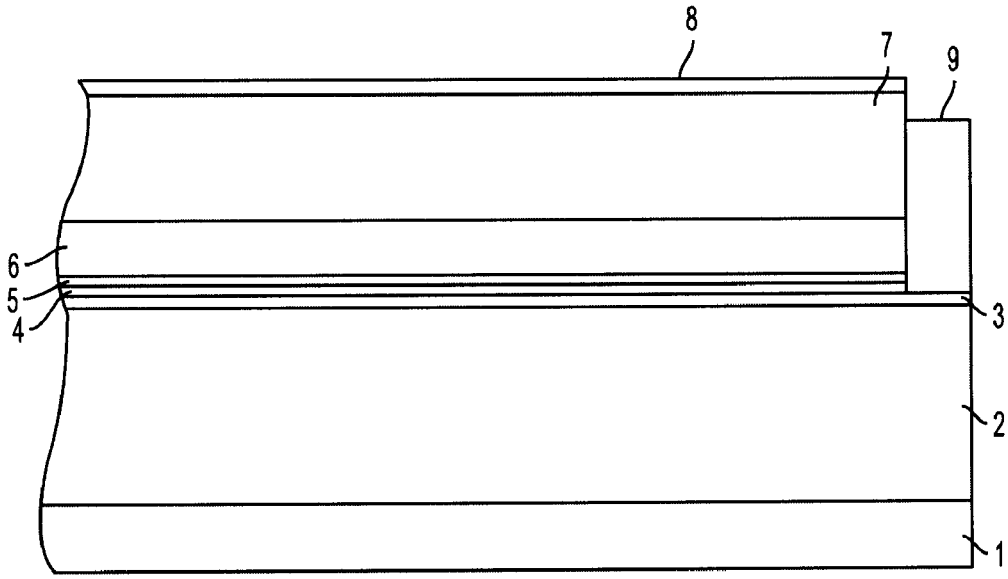
FIG. 2 is an exemplary diagram of a cross-section of an imaging member.

FIG. 2 is an exemplary diagram of a cross-section of an imaging member 10 that may be formed by the imaging member forming system 100. The imaging member 10 may include an anti-curl layer 1, a substrate 2, an electrically conductive ground plane 3, a charge-blocking layer 4, an adhesive layer 5, a charge-generating layer 6, a charge-transport layer 7, an overcoating layer 8, and a ground strip 9. Although the imaging member 10 is discussed as a photoreceptor, it should be appreciated that the imaging member 10 shown in FIG. 1 may be any member that forms or retains an image, and the imaging member may include more or less layers without departing from the spirit and scope of the disclosure.

The anti-curl layer 1 may include film-forming organic or inorganic polymers that are electrically insulating or slightly semi-conductive. The anti-curl layer provides flatness and/or abrasion resistance. The thickness of the anti-curl layer may be about 3 micrometers to about 35 micrometers. However, thicknesses outside this range may be used. An anti-curl coating may be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. The imaging layers on top of the substrate and the anti-curl layer may be simultaneously web coating onto a multilayer photoreceptor that includes a charge transport layer, charge-generating layer, adhesive layer, blocking layer, ground plane and substrate. The wet film coating may then be dried to produce the anti-curl layer 1.

Figure 3:
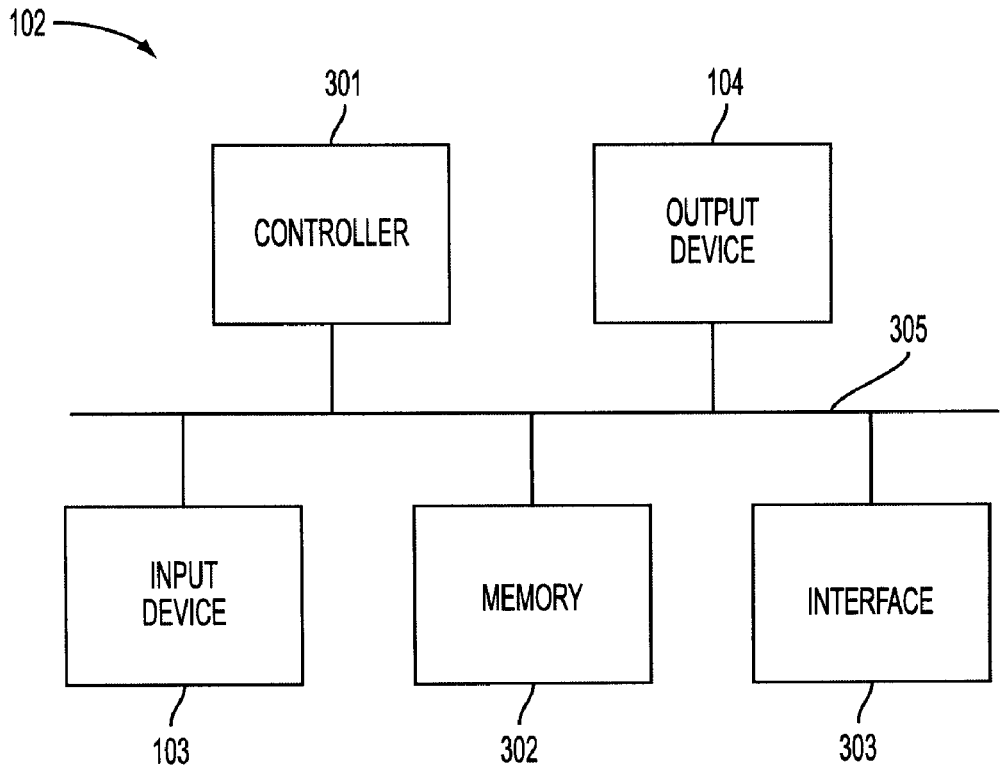
FIG. 3 is an exemplary diagram of a controller used in the imaging member forming system.

FIG. 3 is an exemplary diagram of a control system 102 that may be used in the imaging member forming system 100. The control system 102 may include a controller 301, memory 302 and an interface 303. Each of the devices 301-303 may be connected via a bus 305. The input device 103 and output device 104 may also be connected to the bus 305. The interface 303 facilitates communication between the devices 103, 104, 301 and 302. The memory 302 may be any storage device, for example, which may include databases shared in a variety of memory types such as disks, tapes, hard drives, RAM, etc.

In the illustrated embodiments, the controller 301 is implemented with a general purpose processor. It will be appreciated by those skilled in the art that the controller 301 may be implemented using a single special purpose integrated circuit (e.g., ASIC) having a main or central processor section for overall, system-level control, and separate sections dedicated to performing various different specific computations, functions and other processes under control of the central processor section. The controller 301 may be a plurality of separate dedicated or programmable integrated or other electronic circuits or devices (e.g., hardwired electronic or logic circuits such as discrete element circuits, or programmable logic devices such as PLDs, PLAs, PALs or the like). The controller 301 may be suitably programmed for use with a general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller 3 01. A distributed processing architecture can be used for maximum data/signal processing capability and speed.

As discussed above, the imaging member 10 may include a substrate 2. The substrate 2 may be opaque or substantially transparent and can include any of numerous suitable materials having required mechanical properties. The substrate 2 may include a layer of electrically non-conductive material or a layer of electrically conductive material, such as an inorganic or organic composition. The substrate 2 may be flexible or rigid and may have any of a number of different configurations, such as, for example, a sheet, a scroll, an endless flexible belt, a web, a cylinder, and the like. The imaging member 10 may be coated on a rigid, opaque, conducting substrate, such as an aluminum drum.

When a non-conductive substrate is employed, an electrically conductive ground plane 3 may be employed. The ground plane 3 may act as the conductive layer. When a conductive substrate is used, the substrate 2 may act as the conductive layer, although a conductive ground plane may also be provided. If an electrically conductive ground plane is used, it may be positioned over the substrate 2. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys.

After deposition of an electrically conductive ground plane layer, a charge-blocking layer 4 may be formed. Electron blocking layers for positively charged photoreceptors permit holes from the imaging surface of the photoreceptor to migrate toward the conductive layer. For negatively charged photoreceptors, any suitable hole-blocking layer can be utilized that forms a barrier to prevent hole injection from the conductive layer to the opposite photoconductive layer. If a blocking layer is used, it may be positioned over the electrically conductive layer. The ground plane can be applied by known coating techniques, such as solution coating, vapor deposition, and sputtering. Other suitable methods can also be used.

An intermediate layer 5 between the blocking layer and the charge-generating layer 6 may, if desired, be formed to promote adhesion. A dip coated aluminum drum may also be used without an adhesive layer. Adhesive layers may be provided, if necessary, between any of the layers in the photoreceptors to ensure adhesion of any adjacent layers. Adhesive material may be incorporated into one or both of the respective layers to be adhered.

In forming the imaging member 10, a charge-generating material and a charge transport material may be deposited onto the substrate surface either in a laminate type configuration (where the charge-generating material and charge transport material are in different layers) or in a single layer configuration (where the charge-generating material and charge transport material are in the same layer along with a binder resin). Using these materials, the photoreceptors may be prepared by applying over the electrically conductive layer the charge-generating layer 6 and, optionally, a charge transport layer 7. The charge-generating layer 6 and the charge transport layer 7 may be formed in any order.

As discussed above, the pigment used to form the coating material for current photoreceptors is highly sensitive and is composed of various particle sizes so that the photoreceptor may be used for high speed black-and-white and color applications with a very long life. However, because of the problems associated with the pigment particle size, there is a need for a pigment material that allows an improved print quality by better dispersing the pigment particle size in the charge-generating layer 6. Thus, the pigment used to form the charge-generating layer 6 in FIG. 1 may be formed by dry ball milling, for example, hydroxygallium phthalocyanine (I). The dry ball milling step may be performed prior to the conversion to hydroxygallium phthalocyanine (V) from crude hydroxygallium phthalocyanine (I).

The pigment used in the coating material may be dry milled in conjunction with a dry ice treatment. The result is an improved particle size reduction and particle size distribution of hydroxygallium phthalocyanine (I) that is formed using a reduced production milling time. Moreover, there is a significant improvement in print quality.

Experiment 1

The hydroxygallium phthalocyanine (I) may be pre-milled. Specifically, the pre-milling may be performed by milling 13 g of hydroxygallium phthalocyanine (I) lot 30 with a lab size attritor with 130 g of 6 mm diameter glass beads. The milling may be performed for 2 hrs with crushed $CO_2$ (s). The attritor may be set at 100% power.

Next, a pigment cake may be formed from the. pre-milled hydroxygallium phthalocyanine (I). Specifically, the hydroxygallium phthalocyanine (I) may be separated from the beads and 3 g of the hydroxygallium phthalocyanine (I) may be added to a 125 ml amber bottle with 30 g dimethylforamide (DMF) and 60 g of 6 mm diameter glass beads. The sample may then be roll milled at 150 revolutions/minute for 24 hrs. The sample may then be collected with a suction filtration through a 5 um fritted glass filter and rinsed with n-butylacetate. The pigment cake that includes the hydroxygallium phthalocyanine (I) may then be dried under 30 Torr vacuum @ 125 C for 12 hrs.

Next, the particle size of the pigment material may be reduced. Specifically, 2.5 g hydroxygallium phthalocyanine (I) from the pigment cake may be mixed with 32.5 g of a vinyl acetate/vinyl chloride co-polymer in n-butleacetate of 5% solid content and then charged into a lab size attritor with 130 mm of 1 mm diameter glass beads. The dispersion of the pigment material is then monitored via UV-Vis spectrophotometer to confirm a particle size reduction, where a relative scattering index, defined as the absorbance ratio between absorption peak at ~830 nm and absorbance @ 1000 nm, is monitored as an indication of particle size and distribution. The dispersion of the pigment material may be deemed acceptable when the RSI value of the hydroxygallium phthalocyanine (I) is measured at a specific predetermined level.

Next, the pigment dispersion may be diluted. Specifically, the dispersion of the pigment material may be diluted to 5% solids with n-butylacetate and filtered through 20 micrometer filter cloth.

The imaging member may now be formed with the pigment material. For example, the resultant dispersion may be dip-coated on a (404×30 mm) aluminum drum. The imaging member may include a 1.1 micrometer of undercoat layer that includes silane and polyvinylbutyral, a 15 to 30 micrometer charge transporting layer, that includes an arylamine and polycarbonate.

Experiment 2

Experiment 2 is similar to Experiment 1. However, 1 mm diameter glass beads are used during the pre-milling step instead of 6 mm diameter glass beads.

Experiment 3

Experiment 3 is similar to Experiment 1. However, ⅛" cleaned stainless steel shot is used during the pre-milling step instead of 6 mm glass beads.

Experiment 4

Experiment 4 is similar to Experiment 1. However, 2 mm diameter ZrO2 beads are used during the pre-milling step instead of 6 mm glass beads.

Data was obtained from Experiments 1-4 and compared to different hydroxygallium phthalocyanine dispersions as shown in Table 1.0. Although the glass beads used in the experiments were less than 10 mm in diameter, it should be appreciated that the glass beads may be larger than 10 mm diameter without departing from the spirit and scope.

As discussed above, there is a need to reduce the milling time (and particle/agglomerate size) of the hydroxygallium phthalocyanine (I) and to have a dispersion of coating material that yields superior quality prints. The RSI value (e.g., <13) as a function of mill time is greatly reduced, for example, by 3 times when the hydroxygallium phthalocyanine (I) is pretreated by the grinding step in the presence of $CO_2$ (s). The data also shows that when there is a pretreatment of the hydroxygallium phthalocyanine pigment, there is also a shift in the 2 absorption peaks used to determine A:B peak ratio. The increase in the A:B peak ratio, for example, above 0.80 may be an indication that the material has become more crystalline in structure.

The peak shift to a higher or lower wavelength λ indicates a slight change in the crystal stacking which might aid in improving print quality as seen with the Fuji Xerox samples. The data shows that most of the pretreated samples, e.g., Experiments 1-4, show an increase in A:B ratio and reduction in mill time compared to the sample results from hydroxygallium phthalocyanine without pre-milling. Any decrease in print quality for the $CO_2$ (s) pre-milled samples may be the result of contamination from the $CO_2$ (s). Also, an addition of extra steps like centrifugation, filtering, dispersion polishing, and a mixed solvent system, may yield improve print quality.

| Sample Details | Experiment No. | Mill Time (hrs.) | Peak Position (λ in nm) A | Peak Position (λ in nm) B | RSI Value (Abs. @ 1000 nm)/(Abs. @ Peak A * 100) | A/B Peak Ratio |
|---|---|---|---|---|---|---|
| Control* Fuji Xerox hydroxygallium phthalocyanine/NBA/MIBK 2:1 | N/A | N/A | 1.263 @ 814 | 1.273 @ 640 | 3.17 | 1.01 |
| Fuji Xerox hydroxygallium phthalocyanine Xerox Corp. Mill method w/ No Pre-milling | N/A | 0.5 | 1.167 @ 814 | 1.104 @ 640 | 9.35 | 0.92 |
| Hydroxygallium phthalocyanine w/ No Pre-milling | N/A | 3 | 1.223 @ 826 | 1.107 @ 640 | 9.89 | 0.91 |
| Hydroxygallium phthalocyanine w/ SS Shot Pre-milling Step w/ CO2 | 3 | 1.0 | 1.305 @ 830 | 0.972 @ 630 | 7.74 | 0.74 |
| Hydroxygallium phthalocyanine w/ 6 mm Glass Pre-milling Step w/ CO2 | 1 | 1.0 | 1.358 @ 864 | 1.638 @ 838 | 9.28 | 1.21 |
| Hydroxygallium phthalocyanine w/ 1 mm Glass Pre-milling Step w/ CO2 | 2 | 2.0 | 1.324 @ 824 | 1.216 @ 640 | 12.54 | 0.92 |

-continued

| Sample Details | Experiment No. | Mill Time (hrs.) | Peak Position (λ in nm) A | B | RSI Value (Abs. @ 1000 nm)/ (Abs. @ Peak A * 100) | A/B Peak Ratio |
|---|---|---|---|---|---|---|
| Xerox Corp hydroxygallium phthalocyanine w/ 2 mm ZrO2 Pre-milling Step w/ CO2 | 4 | 1.5 | 1.350 @ 840 | 1.081 @ 634 | 10.67 | 0.8 |

*The control sample was optimized by adding a centrifugation step to remove large pigment particles and agglomerates. The control sample was also continuously filtered (5 μm) and diluted with MIBK for improved coating quality. In comparison, the other samples in Table 1 were only filtered through a 20 μm filter cloth.

Figure 4:
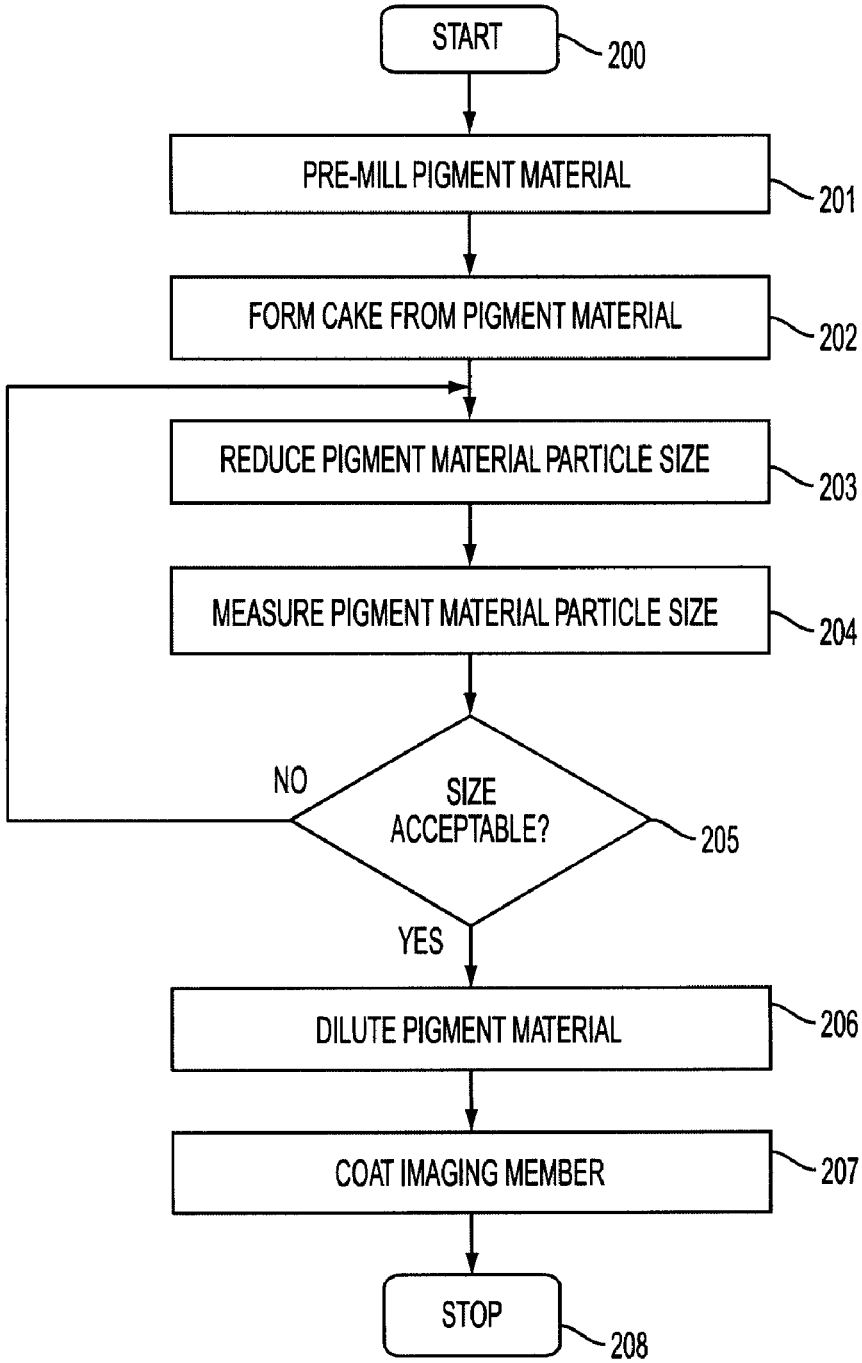
FIG. 4 is an exemplary flowchart of a method for forming a layer on an imaging member.

FIG. 4 is an exemplary flowchart of a method for forming a layer, e.g., a pigment material, on an imaging member. After the routine begins in step 200, the pigment material is pre-milled in step 201. Then, control shifts to step 202. In step 202, the pre-milled pigment material is formed into a cake. Control then shifts to step 203. In step 203, the pigment material cake is processed so that the size of the pigment material particles is reduced to an acceptable size. Next, control shifts to step 204.

In step 204, the pigment material particle size is measured. Control then shifts to step 205. In step 205, it is determined whether the pigment material particle size is acceptable. If it is determined in step 205 that the pigment material particle size is not acceptable, then control returns to step 203 and the pigment material particle size is reduced. If it is determined in step 205 that the pigment material particle size is acceptable, then control shifts to step 206. In step 206, the pigment material is diluted. Control then shifts to step 207. In step 207, the photoreceptor is coated with the pigment material. Control then shifts to step 208 where control stops.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of forming a layer on an imaging member, comprising:

pre-milling a charge-generating pigment material by dry ball milling the charge-generating pigment material with crushed $CO_2$ as an agent in the dry ball milling mixture;

reducing the size of particles of the charge-generating pigment material by milling the pre-milled charge-generating pigment material with glass beads;

measuring a size of the particles of the milled charge-generating pigment material;

determining whether that measured size of the particles is acceptable; and coating the imaging member with the milled charge-generating pigment material if it is determined that the measured size of the particles is acceptable.

2. The method of claim 1, comprising the imaging member being a photoreceptor, and the charge-generating pigment material including hydroxygallium phthalocyanine (I) that forms a charge-generating layer.

3. The method of claim 1, wherein the pre-milling further comprises glass beads as an agent in the dry ball milling mixture.

4. The method of claim 1, wherein the pre-milling is performed for at least five minutes and no more than ten hours.

5. The method of claim 2, comprising forming a pigment cake of the coating material by adding the $CO_2$ pre-milled hydroxygallium phthalocyanine (I) to a solvent and milling media, and then agitating the mixture.

6. The method of claim 1, wherein the reducing the size of particles is performed by milling the mixture 1 mm diameter glass beads.

7. The method of claim 1, comprising the charge-generating pigment material being deemed acceptable when the size of the particles is measured to be less than a predetermined value.

8. The method of claim 1, wherein the pre-milling comprises dry ball milling the charge-generating pigment material with the crushed $CO_2$ and glass beads that are smaller than 10 mm in diameter.

9. The method of claim 1, wherein the pre-milling comprises dry ball milling the charge-generating pigment material with the crushed $CO_2$ and stainless steel shot.

10. The method of claim 1, wherein the pre-milling comprises dry ball milling the charge-generating pigment material with the crushed $CO_2$ and $ZrO_2$ beads.

11. A method of forming a layer on an imaging member, comprising:

pre-milling a hydroxygallium plithalocyanine pigment material by dry ball milling the hydroxygallium phthalocyanine pigment material with crushed $CO_2$ as an agent in the dry ball milling mixture;

reducing the size of particles of the hydroxygallium phthalocyanine pigment material by milling the pre-milled hydroxygallium phthalocyanine pigment material with glass beads;

measuring a size of the particles of the milled hydroxygallium phthalocyanine pigment material;

determining whether that measured size of the particles is acceptable; and coating the imaging member with the milled hydroxygallium phthalocyanine pigment material if it is determined that the measured size of the particles is acceptable.

12. The method of claim 11, wherein the pre-milling comprises dry ball milling the hydroxygallium phthalocyanine pigment material with the crushed $CO_2$ and at least one of glass beads, stainless steel shot, or $ZrO_2$ beads.

* * * * *